US009917395B2

(12) United States Patent
Yoshida

(10) Patent No.: US 9,917,395 B2
(45) Date of Patent: Mar. 13, 2018

(54) LEVER-TYPE CONNECTOR

(71) Applicant: Sumitomo Wiring Systems, Ltd., Yokkaichi, Mie (JP)

(72) Inventor: Yutaro Yoshida, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/426,126

(22) Filed: Feb. 7, 2017

(65) Prior Publication Data

US 2017/0229805 A1 Aug. 10, 2017

(30) Foreign Application Priority Data

Feb. 9, 2016 (JP) ..... 2016-022328

(51) Int. Cl.
*H01R 13/62* (2006.01)
*H01R 13/52* (2006.01)

(52) U.S. Cl.
CPC ..... *H01R 13/5213* (2013.01)

(58) Field of Classification Search
CPC ..... H01R 13/62938; H01R 13/633; H01R 13/635; H01R 13/62933; H01R 23/688
USPC ..... 439/157, 152, 159, 372, 607.1
See application file for complete search history.

(56) References Cited

U.S. PATENT DOCUMENTS 7,201,592 B2 * 4/2007 Hata ..... H02G 3/0691 439/206
7,476,121 B2 * 1/2009 Tsuji ..... H01R 13/4223 439/465

FOREIGN PATENT DOCUMENTS

JP 2013-45509 3/2013

* cited by examiner

*Primary Examiner* — Phuong Chi T Nguyen
(74) *Attorney, Agent, or Firm* — Gerald E. Hespos; Michael J. Porco; Matthew T. Hespos

(57) ABSTRACT

A lever-type connector 10 disclosed by this specification includes a housing (20), a lever (40), a cover (50) and a lever lock portion (23) provided to extend backward from a rear end (22) of the housing (20) and hold the lever (40) at a rear position by locking an operating portion (42). The cover (50) is composed of an upper cover (52) and a lower cover (51) to be assembled below the upper cover (52). The upper cover (52) includes an upper locking portion (56) configured to cover an upper lock receiving portion (24) provided on the rear end (22) of the housing (20) from above and lock the upper lock receiving portion (24) from front and the lever lock portion (23) is arranged along an upper surface of the upper cover (52).

4 Claims, 12 Drawing Sheets

LEVER-TYPE CONNECTOR

BACKGROUND

1. Field of the Invention

This specification relates to a lever-type connector.

2. Description of the Related Art

Japanese Unexamined Patent Publication No. 2013-45509 discloses a lever-type connector with a rotary lever. The lever-type connector includes a female housing, a U-shaped lever rotatably mounted on the female housing and a housing lock that extends back from an upper part of a rear wall of the female housing to hold the lever at a connection position. The lever includes left and right arms arranged respectively along left and right side walls of the female housing and an operating portion that couples ends of the arms to each other. The operating portion has a lever lock to lock the housing lock at the connection position.

A wire cover is mounted on the connector, and the wire cover has a U-shaped cut for drawing wires to outside. The housing lock is arranged inside the cut when the wire cover is mounted on the connector to prevent the housing lock from interfering with the wire cover when mounting the wire cover. However, clearances must be set between left and right side edges of the cut and the housing lock due to mounting tolerances. Thus, high-pressure washing water, flying stones and the like can enter into connector cavities.

SUMMARY

A lever-type connector disclosed by this specification includes a housing and a U-shaped lever that has two arms coupled by an operating portion. The arms are mounted rotatably on side surfaces of the housing and the operating portion is arranged at a rear position behind the housing. A cover is to be assembled behind the housing and below the lever arranged at the rear position. A lever lock extends back from a rear end of the housing and holds the lever at the rear position by locking the operating portion. The cover has an upper cover and a lower cover to be assembled below the upper cover. The upper cover includes an upper lock configured to cover an upper lock receiving portion on the rear end of the housing from above and locks the upper lock receiving portion from the front. The lever lock is arranged along an upper surface of the upper cover.

According to this configuration, the lever lock is arranged along the upper surface of the upper cover and the upper lock of the upper cover locks the upper lock receiving portion of the housing from the front. Thus, the upper cover can be assembled with the housing from behind. Accordingly, the upper cover need not be cut and assembled with the housing from above to avoid interference with the lever lock. Therefore, the rear end of the housing can be covered reliably by the cover to prevent direct splashing of high-pressure washing water, flying stones or the like from entering into connector cavities.

A butting portion of the lower cover to be butted against the upper cover may include a cover lock configured to hold the butting portion of the lower cover. Additionally, a butting portion of the upper cover is to be butted against the lower cover in a butted state by locking a cover lock receiving portion provided on the butting portion of the upper cover from above. According to this configuration, the lower cover can be assembled with the upper cover from below.

The lower cover may include a water stop wall configured to cover facing parts of the butting portion of the upper cover and the butting portion of the lower cover. The water stop wall blocks the intrusion of water into the interior of the cover, thereby preventing direct splashing of high-pressure washing water into the connector cavities.

The lever-type connector disclosed by this specification reliably covers the rear end of the housing and reliably prevents direct splashing of high-pressure washing water, flying stones and the like from entering into the connector cavities.

DETAILED DESCRIPTION

Figure 1:
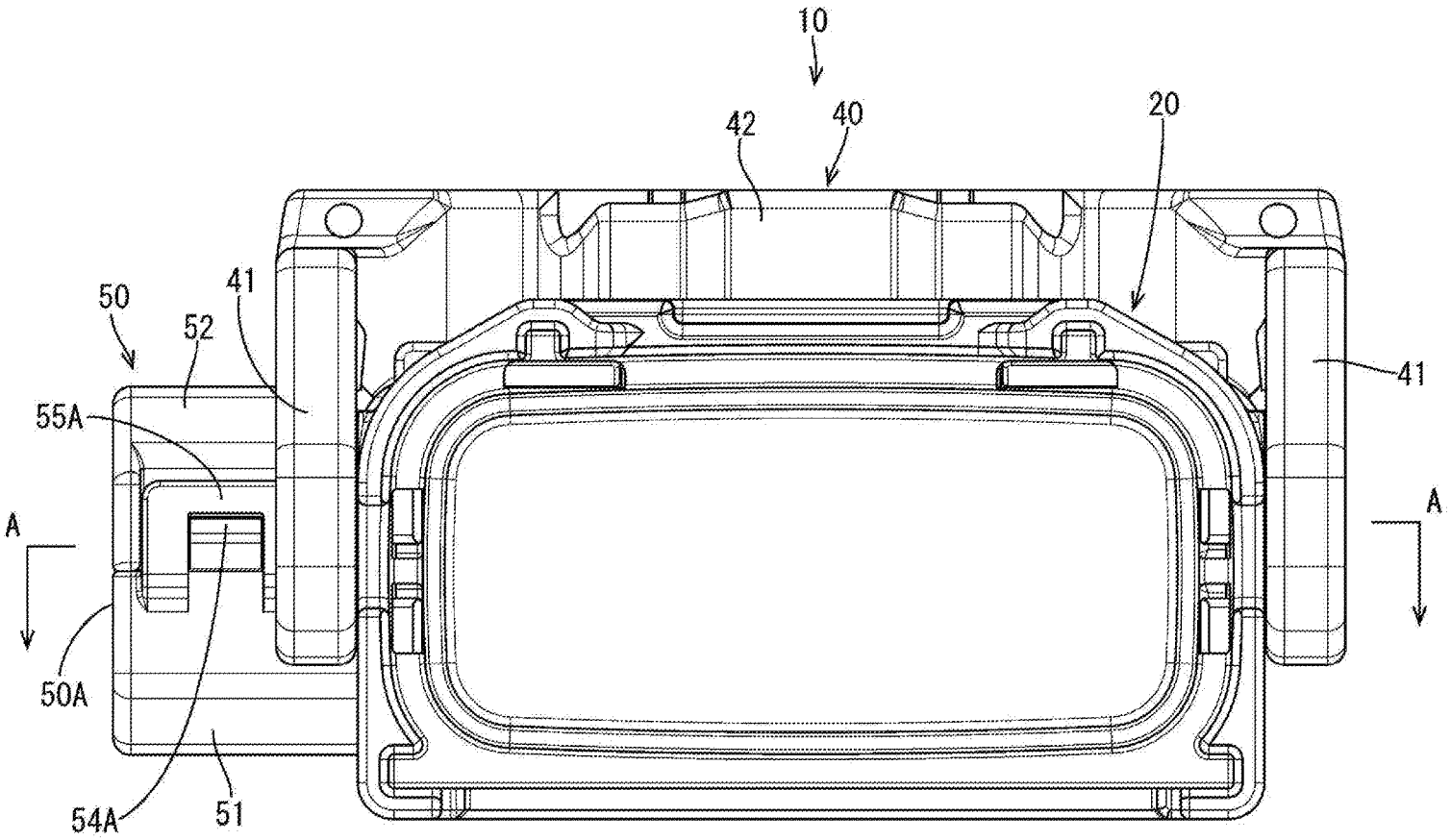
FIG. 1 is a front view of a lever-type connector.
Figure 2:
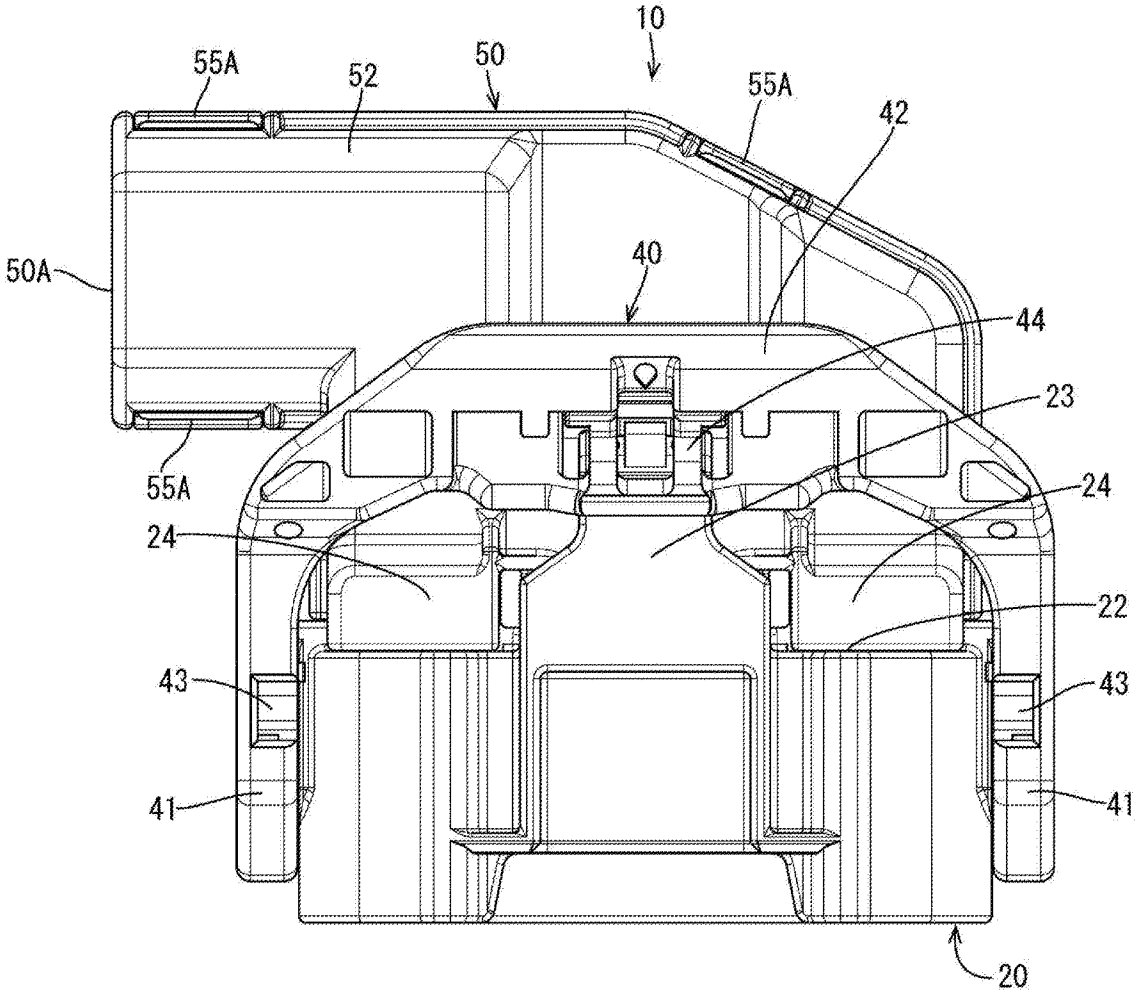
FIG. 2 is a plan view of the lever-type connector.

One embodiment is described with reference to FIGS. 1 to 12. A lever-type connector 10 of this embodiment includes a housing 20, a lever 40 and a cover 50 all of which are made of synthetic resin, and which are shown in FIG. 2. As shown in FIG. 1, the housing 20 is long in a lateral direction and open forward, and unillustrated connector cavities are provided inside the housing 20. Note that the lever-type connector 10 is connectable to an unillustrated mating connector and a connecting direction is a front-back direction in the following description. Further, a vertical direction and the lateral direction are based on FIG. 1.

The connector cavities penetrate the housing 20 in the front-back direction and unillustrated terminals can be accommodated in the respective connector cavities. Each terminal is connected to an end of an unillustrated wire. Each wire is pulled out backward from the housing 20 and is drawn out to the outside of the cover 50 through a wire draw-out opening 50A, shown in FIG. 4, after being bent substantially at a right angle inside the cover 50 to extend left in FIG. 2.

As shown in FIG. 2, the lever 40 has two arms 41 and an operating portion 42 coupling ends of the arms 41 to each other to define a U-shape. The arms 41 are mounted rotatably on both side surfaces of the housing 20. The position of the lever 40 shown in FIG. 2 is a rear position where the operating portion 42 is located behind the housing 20. Although not shown, the lever 40 is rotatable between an upper position where the operating portion 42 is above the housing 20 and the rear position.

Cam grooves 43 are provided on inner side surfaces of the arms 41. Cam pins of the unillustrated mating connector enter the cam grooves 43 and move along the cam grooves 43 as the lever 40 is rotated from the upper position to the rear position so that connection to the mating connector proceeds. Contrary to this, separation from the mating connector proceeds by rotating the lever 40 from the rear position to the upper position.

Figure 8:
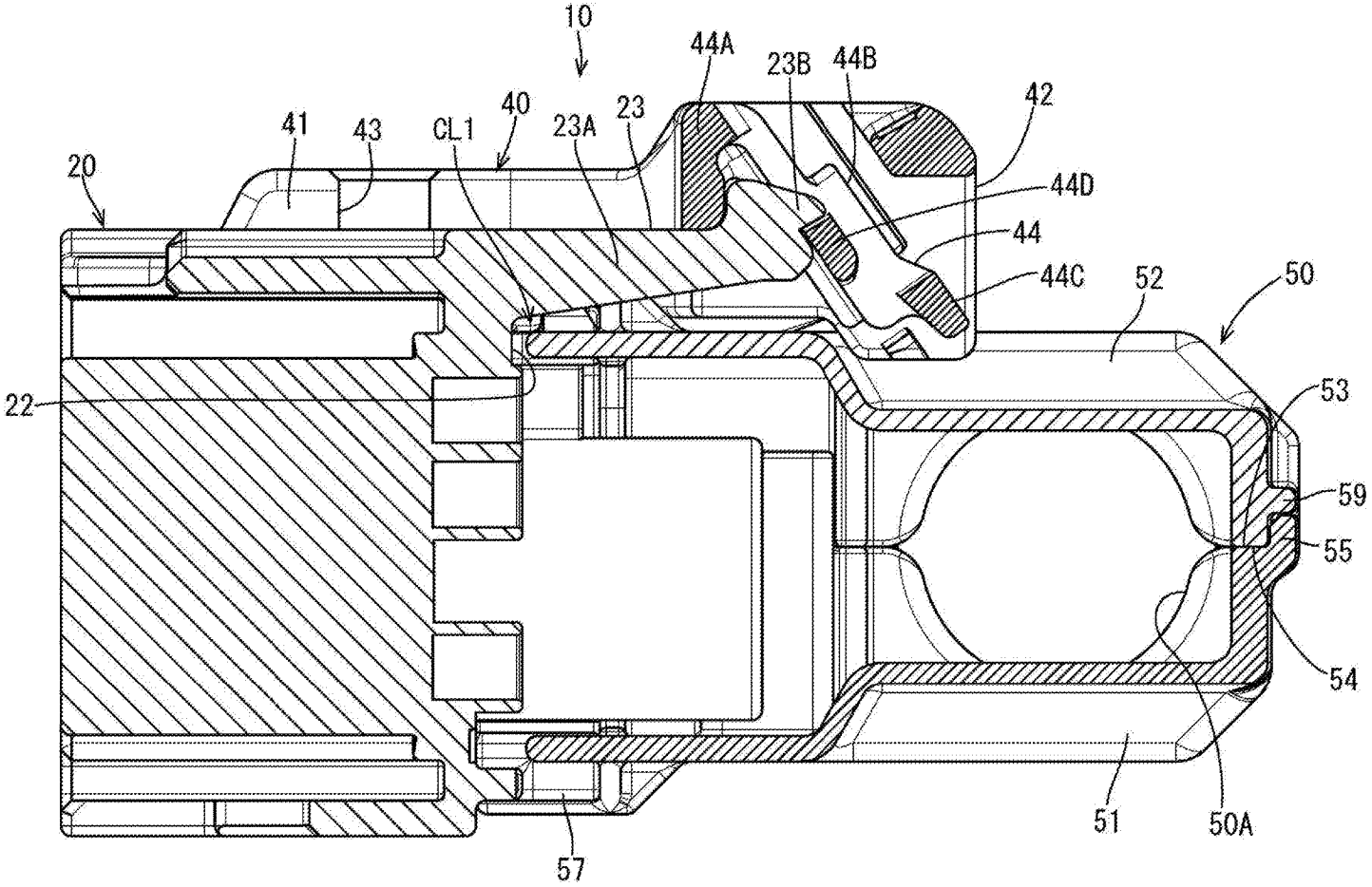
FIG. 8 is a section along B-B of FIG. 7.

A lever lock 23 is provided on an upper part of a rear end 22 of the housing 20 for holding the lever 40 at the rear position. As shown in FIG. 8, the lever lock 23 includes a protruding portion 23A extending back from the upper part of the rear end 22 of the housing 20 and a holding projection 23B projecting up from a rear end part of the protruding portion 23A. The protruding portion 23A is formed such that a plate thickness is reduced toward the rear. The lower surface of the protruding portion 23A of the lever lock portion 23 is arranged along the upper surface of an upper cover 52 to be described later.

On the other hand, the operating portion 42 of the lever 40 is provided with a locking piece 44 to be locked to the lever lock 23. The locking piece 44 is resiliently deformable and includes a base end 44A, a resilient piece 44B cantilevered from the base end 44A, a releasing portion 44C on a projecting end part of the resilient piece 44B and a locking portion 44D at an intermediate position between the base end 44A and the releasing portion 44C. When the lever 40 is rotated from the upper position to the rear position, the base end 44A contacts the upper surface of the protruding portion 23A of the lever lock 23, thereby stopping a rotational movement of the lever 40. Further, when the lever 40 reaches the rear position, the locking portion 44D is locked to the holding projection 23B to hold the lever 40 at the rear position.

Figure 3:
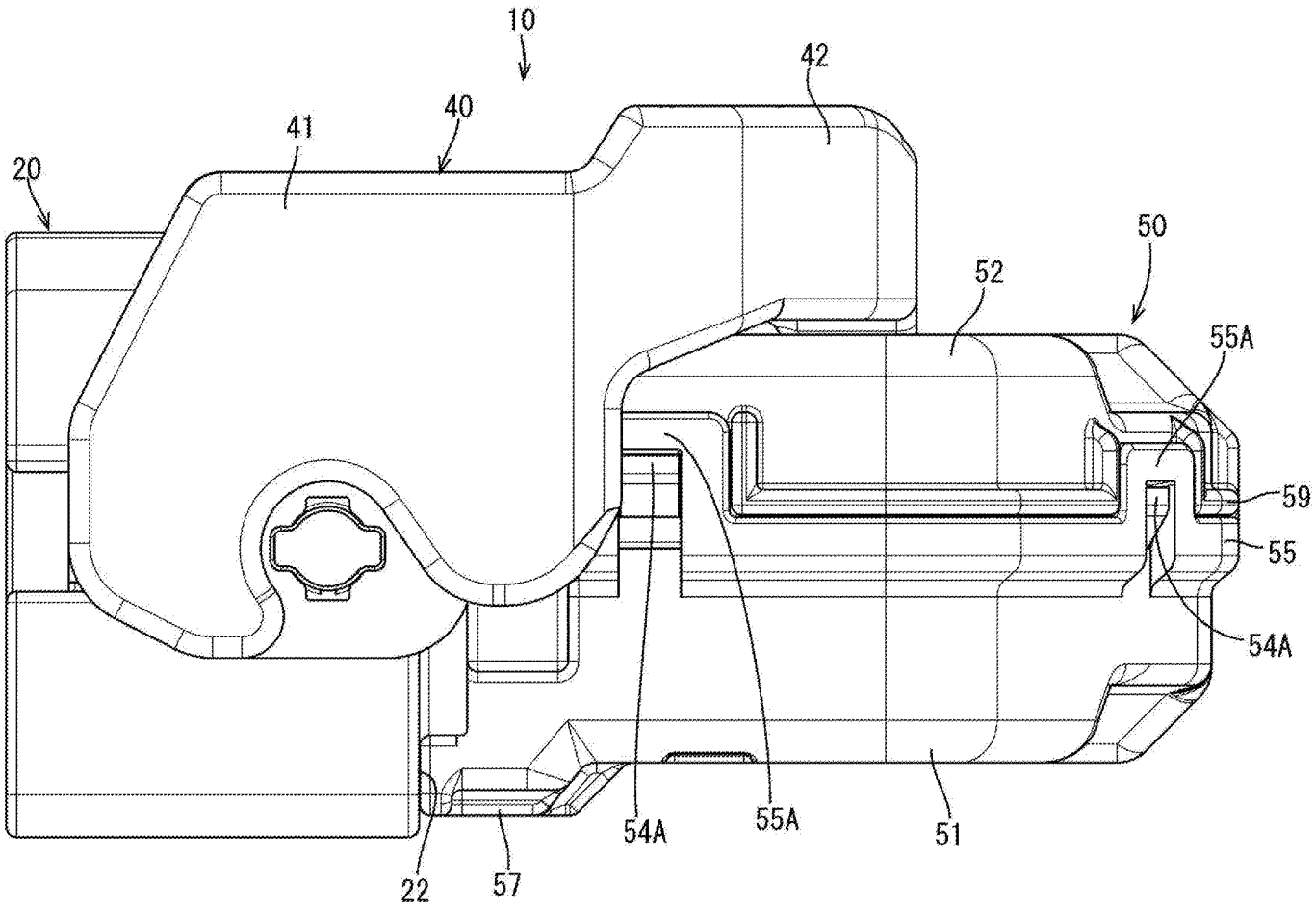
FIG. 3 is a right side view of the lever-type connector.
Figure 4:
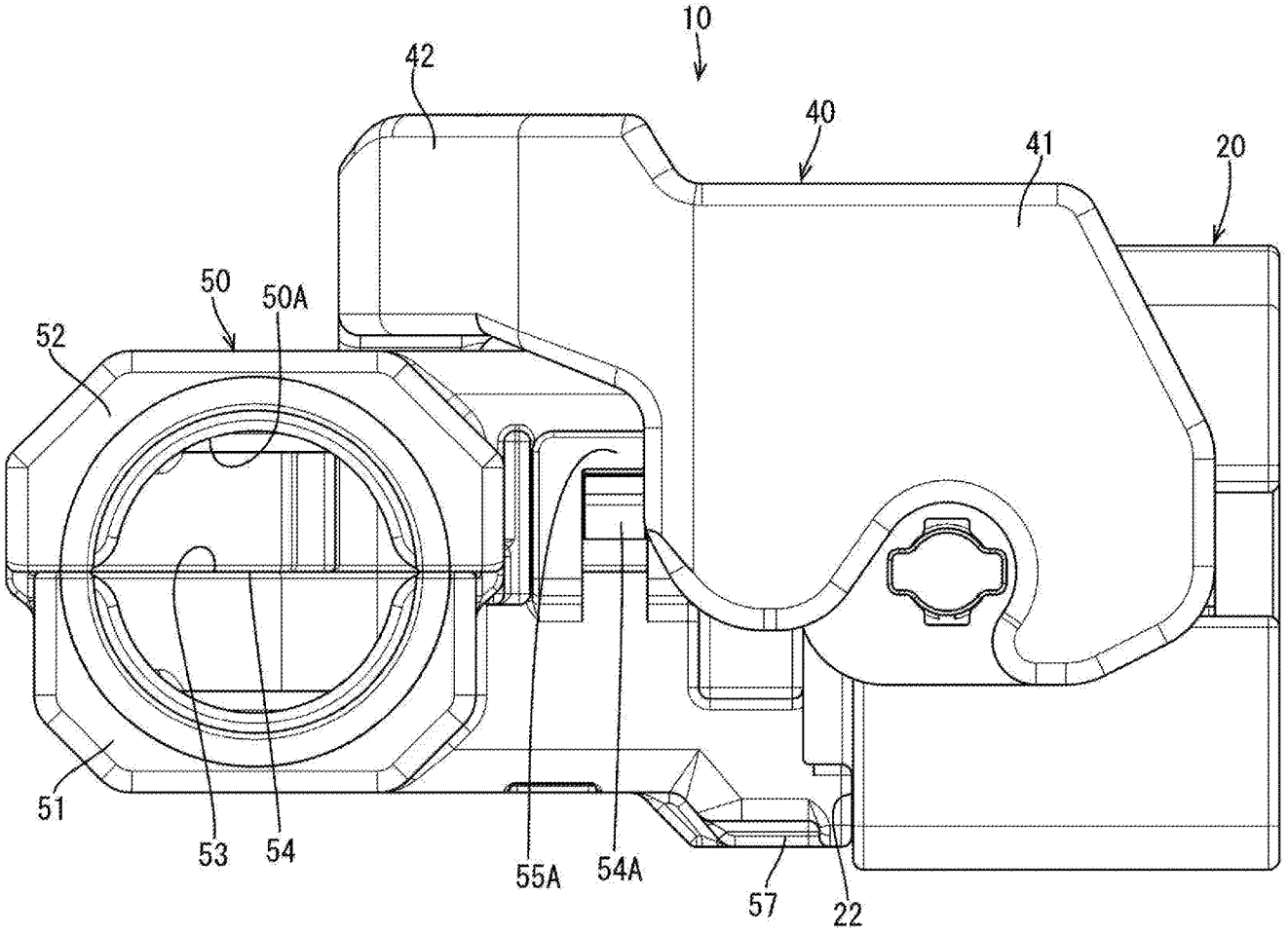
FIG. 4 is a left side view of the lever-type connector.
Figure 5:
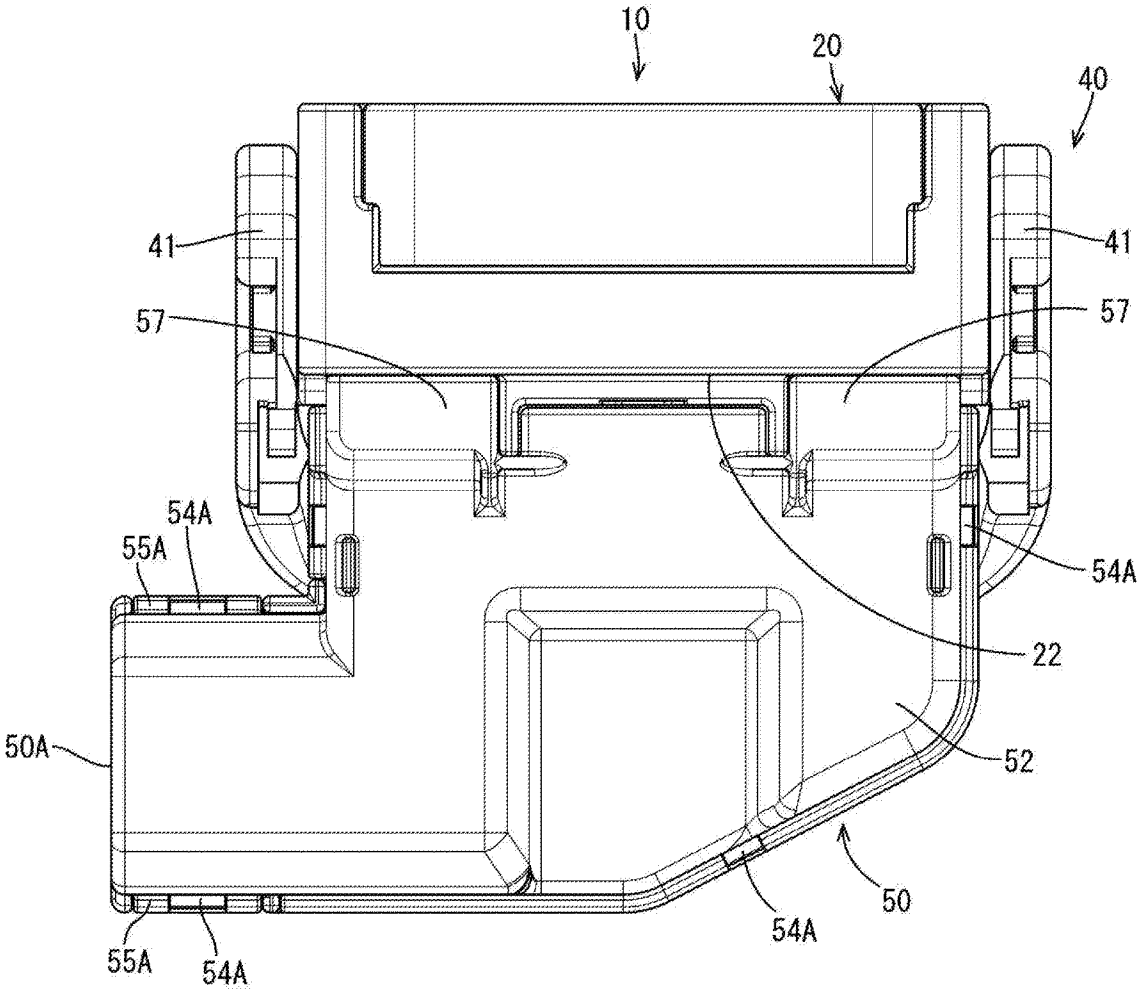
FIG. 5 is a bottom view of the lever-type connector.
Figure 6:
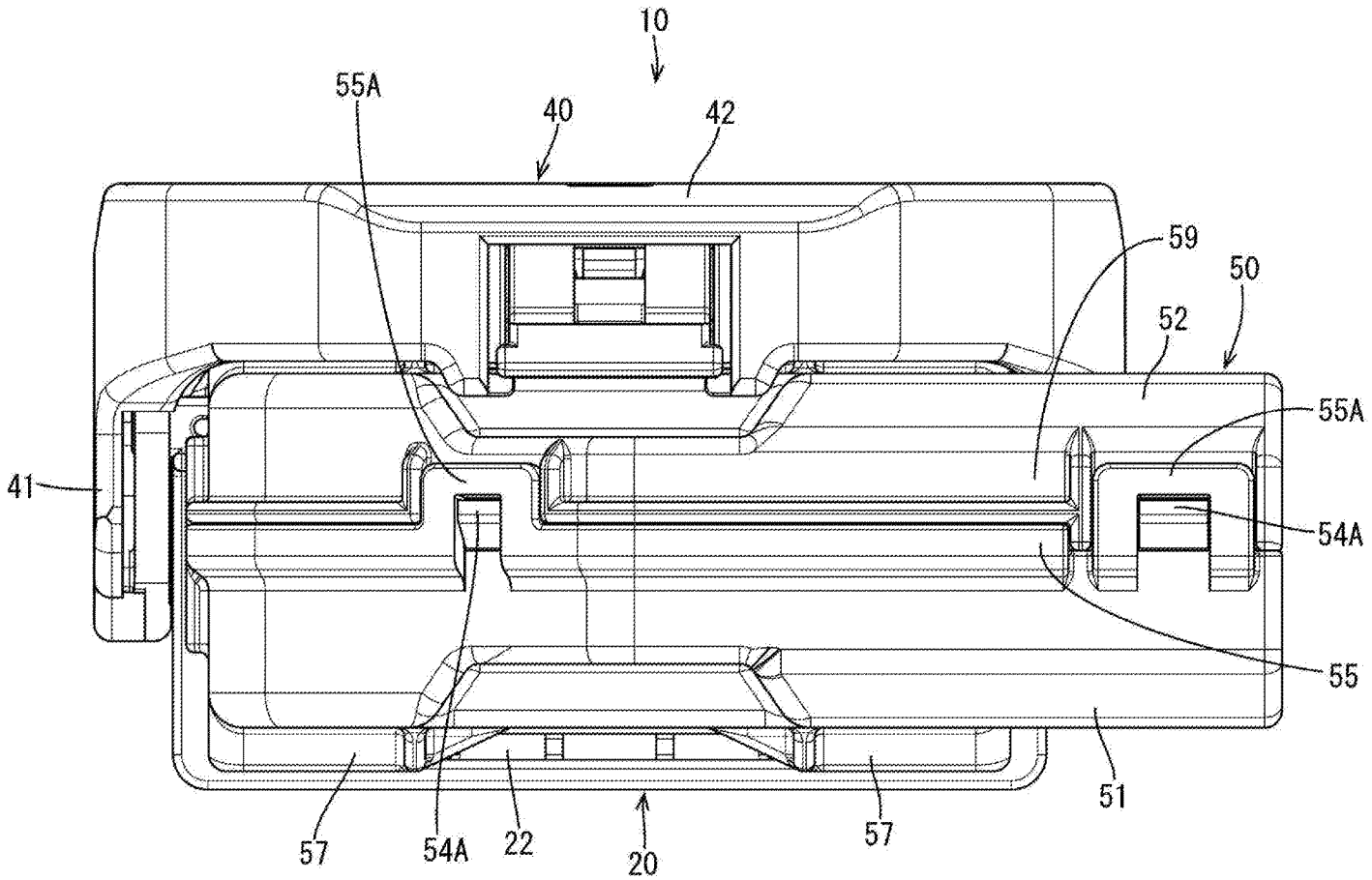
FIG. 6 is a rear view of the lever-type connector.
Figure 9:
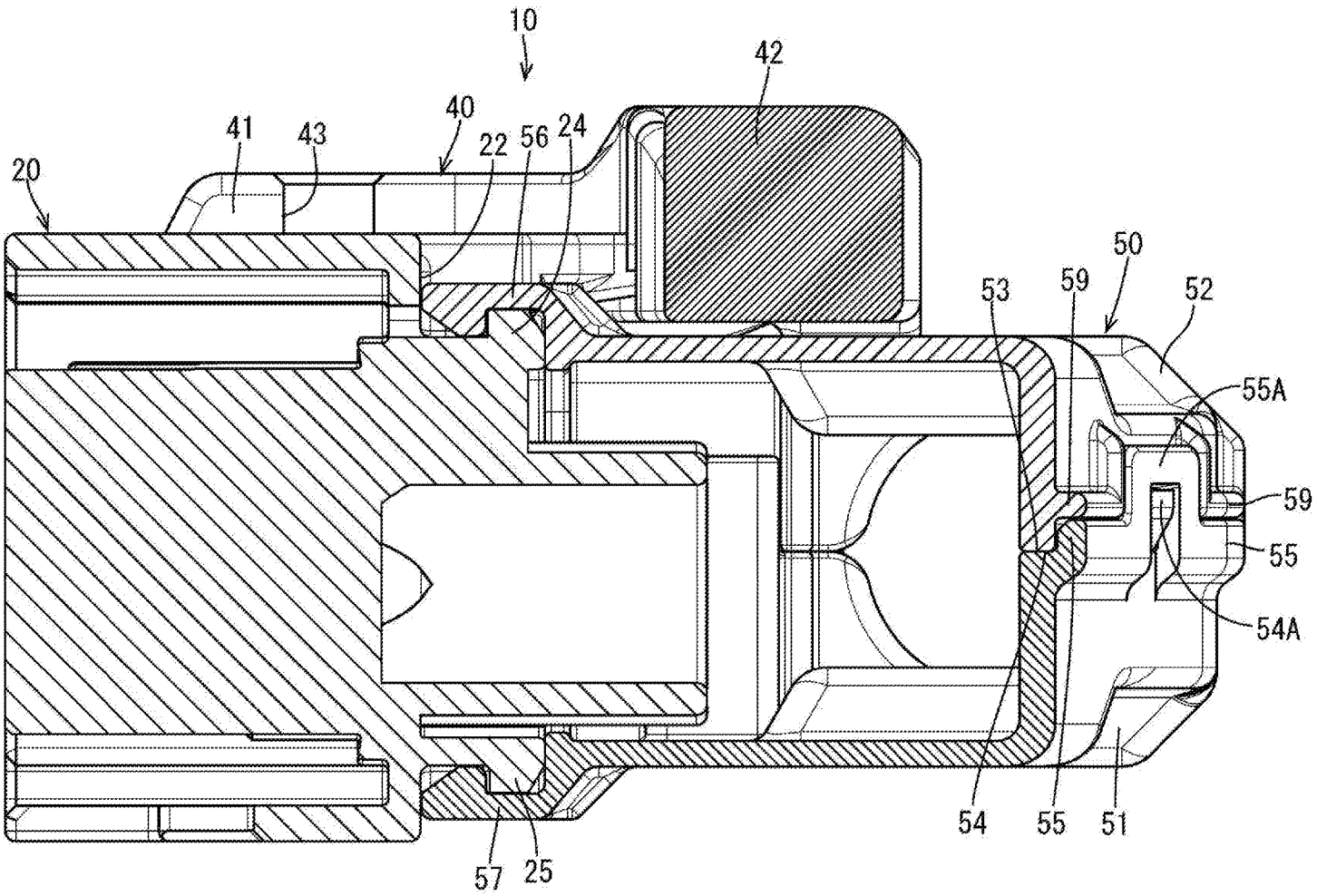
FIG. 9 is a section along C-C of FIG. 7.

As shown in FIG. 3, the cover 50 has a lower cover 51 and the upper cover 52 that are divided vertically into two pieces at a substantially half height position of the cover 50. As shown in FIG. 9, the lower cover 51 includes a butting portion 53 to be butted against the upper cover 52 and the upper cover 52 includes a butting portion 54 to be butted against the lower cover 51.

The butting portion 53 of the lower cover 51 is provided with a water stop wall 55 extending upward along an outer peripheral side surface of the butting portion 54 of the upper cover 52. Further, a water stop wall 55 is provided with a plurality of lock pieces 55A. On the other hand, the butting portion 54 of the upper cover 52 is provided with a plurality of lock protrusions 54A. When the lower cover 51 is assembled with the upper cover 52 from below, each lock piece 55A is locked to the corresponding lock protrusion 54A from above so that the lower cover 51 and the upper cover 52 are assembled integrally and the butting portions 53, 54 are held in a butted state. Further, facing parts of the butting portion 53 of the lower cover 51 and the butting portion 54 of the upper cover 52 are covered from an outer peripheral side by the water stop wall 55. Thus, the water stop wall 55 reliably prevents wetting of the interior of the cover 50 by high-pressure washing water. Note that a covering wall 59 for covering an upper end part of the water stop wall 55 from above is provided on an outer peripheral side surface of the upper cover 52.

Figure 10:
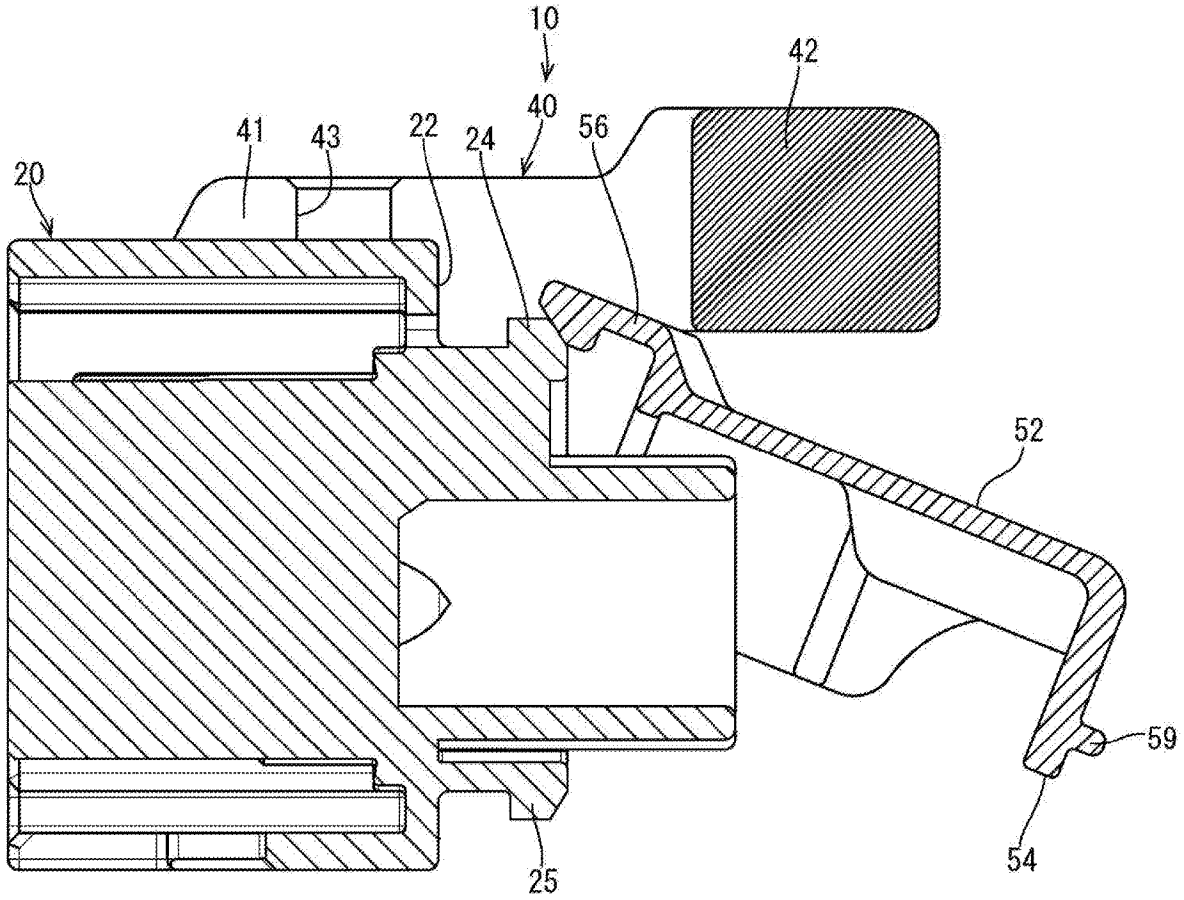
FIG. 10 is a section showing a state while an upper cover is being assembled with a housing.
Figure 11:
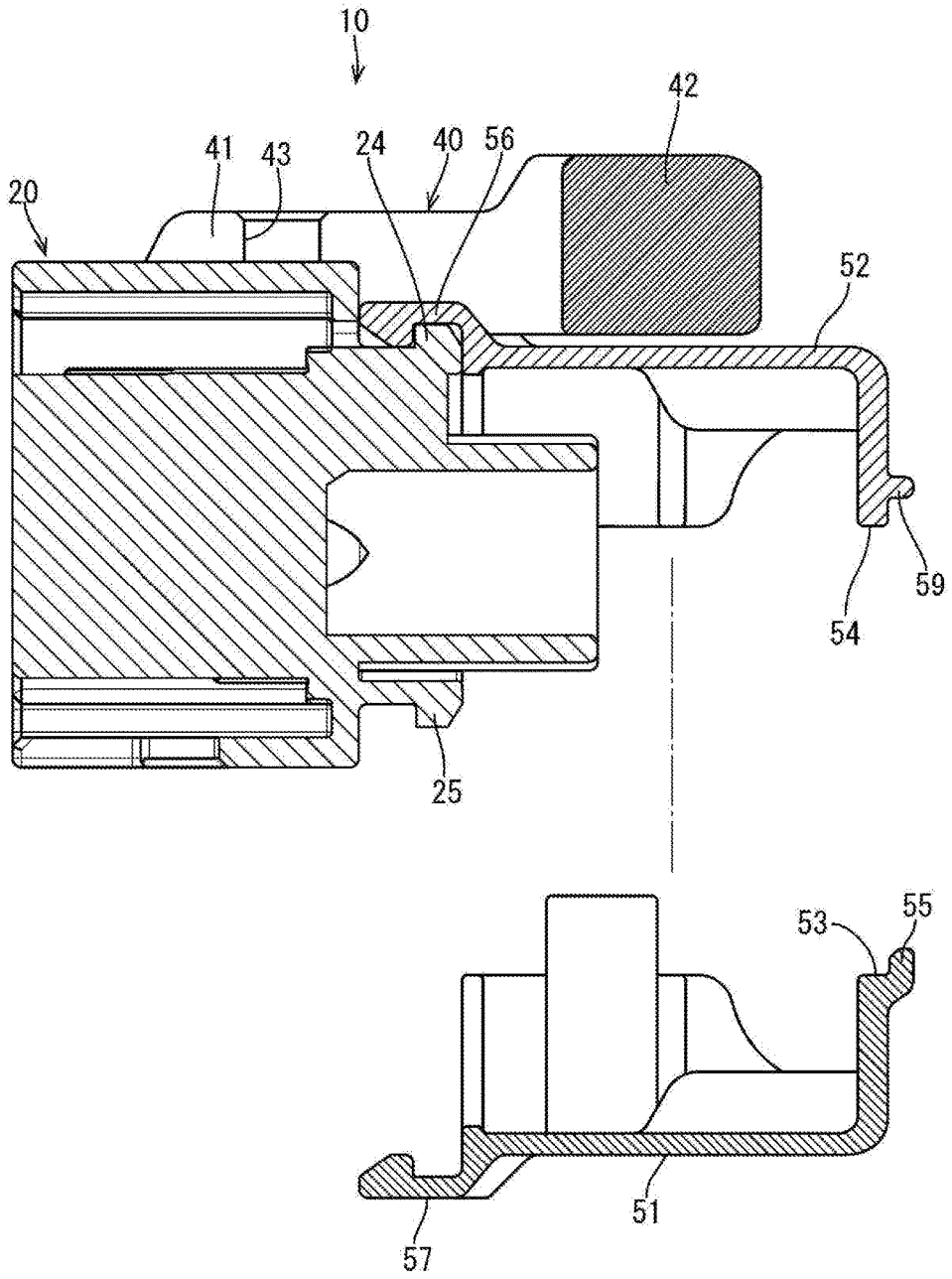
FIG. 11 is a section showing a state before a lower cover is assembled with the upper cover.

The upper cover 52 includes an upper locking portion 56 that covers an upper lock receiving portion 24 provided on the rear end of the housing 20 and locks the upper lock receiving portion 24 from the front. As shown in FIG. 10, the upper cover 52 is assembled with the housing 20 from below while being inclined with respect to the housing 20. When the upper locking portion 56 of the upper cover 52 locks the upper lock receiving portion 24 of the housing 20, as shown in FIG. 11, an opening edge part (left end part) of the upper cover 52 contacts the lower surface of the protruding portion 23A of the lever lock 23, as shown in FIG. 8, so that a locked state is maintained. That is, a clearance CL1 between the opening edge part of the upper cover 52 and the lower surface of the protruding portion 23A of the lever lock portion 23 is smaller than a locking margin between the upper locking portion 56 and the upper lock receiving portion 24, as shown in FIG. 9. Thus, even if the upper cover 52 is inclined by the clearance CL1, the locked state of the upper locking portion 56 and the upper lock receiving portion 24 is maintained and the upper cover 52 is held temporarily on the housing 20. Note that, as shown in FIG. 9, the lower surface of the operating portion 42 of the lever 40 and the upper surface of the upper cover 52 are arranged proximately and the upper locking portion 56 is located in front of the operating portion 42.

The lower cover 51 includes a lower locking portion 57 that covers a lower lock receiving portion 25 on the rear end of the housing 20 from below and locks the lower lock receiving portion 25 from the front. As shown in FIG. 11, the lower cover 51 is assembled with the upper cover 52 from below. When the upper cover 52 is assembled with the lower cover 51, the lower locking portion 57 of the lower cover 51 locks the lower lock receiving portion 25 of the housing 20 from the front, as shown in FIG. 9, so that the lower cover 51 and the upper cover 52 are integrated and held on the housing 20.

Figure 7:
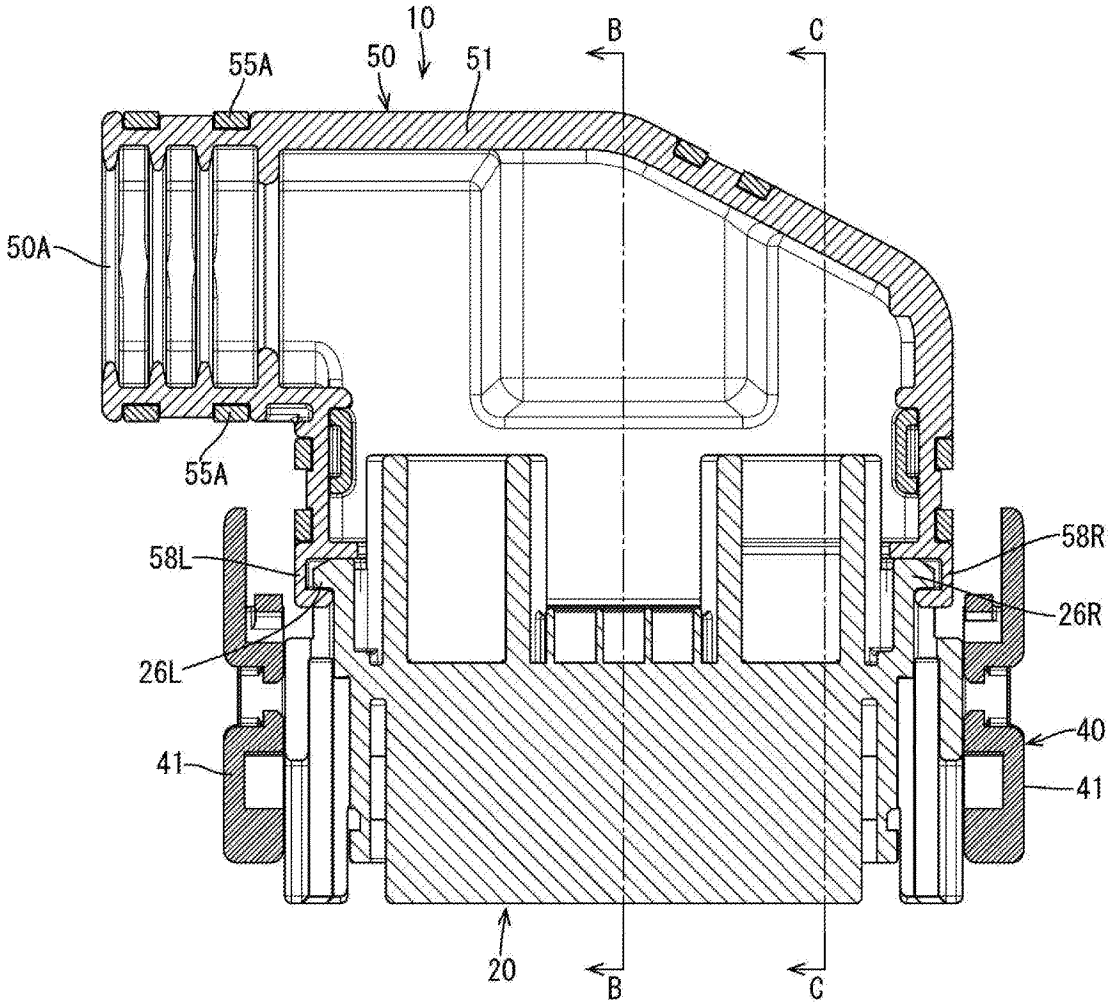
FIG. 7 is a section along A-A of FIG. 1.
Figure 12:
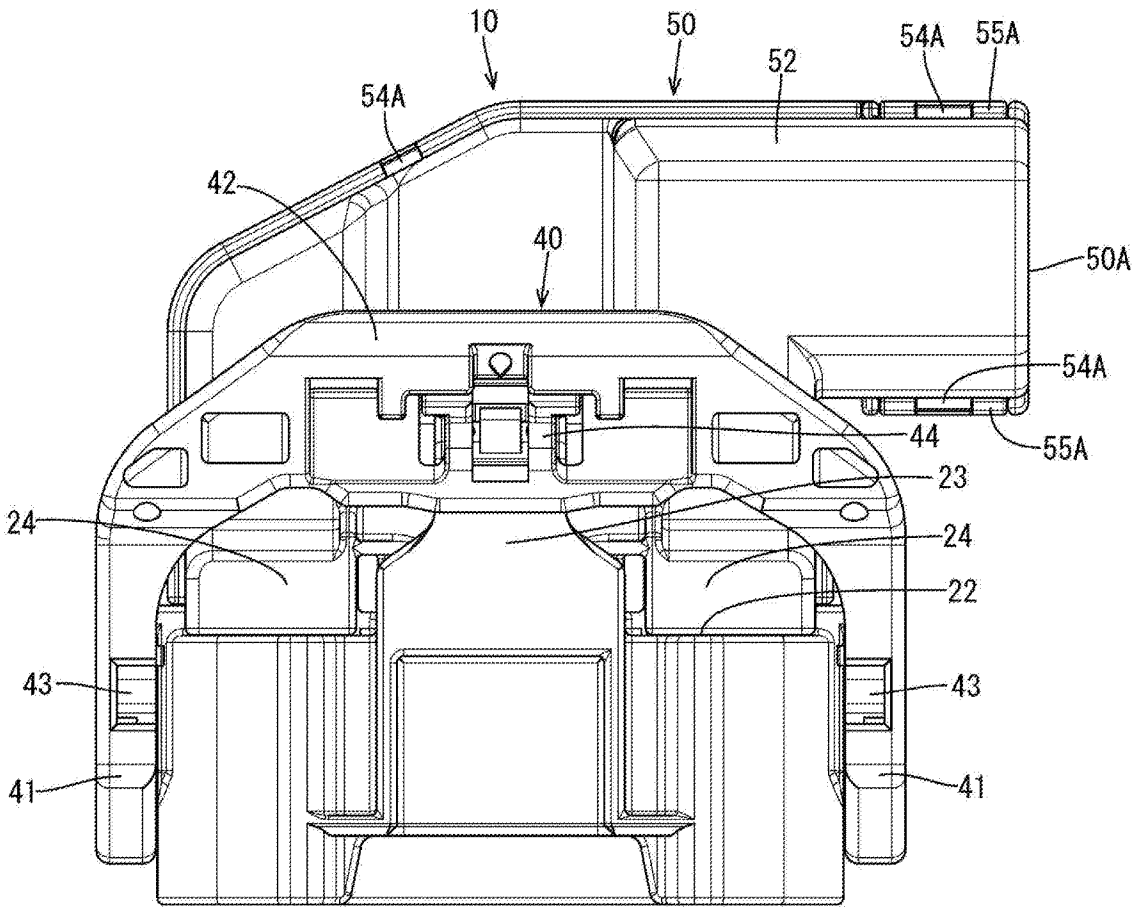
FIG. 12 is a plan view, corresponding to FIG. 2, showing a state where the upper and lower covers are assembled with the housing in a vertically inverted manner.

Further, as shown in FIG. 7, two locking portions 58L, 58R are provided on left and right sides of the cover 50. The locking portions 58L, 58R are configured to cover left and right lock receiving portions 26L, 26R and lock the lock receiving portions 26L, 26R from the front. The locking portions 58L, 58R lock the lock receiving portions 26L, 26R from the front to hold the cover 50 on the housing 20. Furthermore, as shown in FIG. 12, the upper cover 52 and the lower cover 51 can be assembled with the housing 20 in a vertically inverted manner in the cover 50. By doing so, the wires can be drawn out to the right side of the cover 50. In this case, the cover 50 is assembled with the housing 20 by assembling the upper cover 52 with the housing 20 from below after the lower cover 51 is assembled with the housing 20 from behind and temporarily held.

As described above, the lever lock 23 is arranged along the upper surface of the upper cover 52 and the upper locking portion 56 of the upper cover 52 locks the upper lock receiving portion 24 of the housing 20 from the front. Thus, the upper cover 52 can be assembled with the housing 20 from behind. The upper cover 52 need not be cut and assembled with the housing 20 from above to avoid interference with the lever lock 23. Therefore, the rear end 22 of the housing 20 can be covered reliably by the cover 50 and direct splashing of high-pressure washing water into the connector cavities, flying stones and the like can be reliably prevented.

The butting portion 53 of the lower cover 51 to be butted against the upper cover 52 may be provided with a cover lock (lock pieces 55A) to hold the butting portion 53 and the lower cover 51 and the butting portion 54 of the upper cover 52 in the butted state by locking a cover lock receiving portion (lock protrusions 54A) provided on the butting portion 54 of the upper cover 52 to be butted against the lower cover 51. According to this configuration, the lower cover 51 can be assembled with the upper cover 52 from below.

The lower cover 51 may have the water stop wall 55 that covers facing parts of the butting portion 54 of the upper cover 52 and the butting portion 53 of the lower cover 51. Accordingly, the water stop wall 55 stops intrusion of water into the interior of the cover 50, and direct splashing of high-pressure washing water into the connector cavities can be prevented reliably.

The invention is not limited to the above described and illustrated embodiment and includes, for example, the following various modes.

Although the cover 50 in which the butting portions 53, 54 are held in the butted state is illustrated in the above embodiment, the both butting portions 53, 54 may not necessarily be held in the butted state.

Although the lower cover 51 is provided with the water stop wall 55 in the above embodiment, a water stop wall may be provided on the upper cover 52.

LIST OF REFERENCE SIGNS

10 . . . lever-type connector
20 . . . housing
22 . . . rear end
23 . . . lever lock
24 . . . upper lock receiving portion
40 . . . lever
41 . . . arm
42 . . . operating portion
50 . . . cover
51 . . . lower cover
52 . . . upper cover
53 . . . butting portion (of lower cover)
54 . . . butting portion (of upper cover)
54A . . . lock protrusion (cover lock receiving portion)
55 . . . water stop wall
55A . . . lock piece (cover locking portion)
56 . . . upper locking portion

What is claimed is:

1. A lever-type connector, comprising:

a housing having opposite front and rear ends, opposite top and bottom surfaces extending between the front and rear ends and opposite side surfaces extending between the top and bottom surfaces and between the front and rear ends;

a U-shaped lever having two arms and an operating portion coupling the arms, the arms being rotatably mounted on the side surfaces of the housing and the operating portion being at a rear position where the operating portion is behind the rear end of the housing;

a cover assembled to the rear end of the housing and below the lever at the rear position; and a lever lock extending back from top wall of the housing and locking the operating portion for holding the lever at the rear position; wherein:

the cover has an upper cover mounted to areas of the top surface and the side surfaces of the housing adjacent the rear end of the housing and a lower cover assembled below the upper cover; and the upper cover includes an upper locking portion that covers an upper lock receiving portion on the top surface of the housing at a position in proximity to the rear end of the housing from above and locks the upper lock receiving portion from the front, and the lever lock is arranged along an upper surface of the upper cover.

2. The lever-type connector of claim 1, wherein a butting portion of the lower cover to be butted against the upper cover includes a cover locking portion configured to hold the butting portion of the lower cover and a butting portion of the upper cover to be butted against the lower cover in a butted state by locking a cover lock receiving portion provided on the butting portion of the upper cover from above.

3. The lever-type connector of claim 2, wherein the lower cover includes a water stop wall configured to cover facing parts of the butting portion of the upper cover and the butting portion of the lower cover.

4. A lever-type connector, comprising:

a housing having opposite front and rear ends, opposite top and bottom surfaces extending between the front and rear ends and opposite side surfaces extending between the top and bottom surfaces and between the front and rear ends, a lever lock cantilevered back from top wall of the housing, and an upper lock receiving portion on the top surface of the housing at a position in proximity to the rear end of the housing;

a U-shaped lever having two arms and an operating portion coupling the arms, the arms being rotatably mounted on the side surfaces of the housing and the operating portion being at a rear position where the operating portion is behind the rear end of the housing, the operating portion being engaged with the lever lock for holding the operating portion at the rear position; and a cover assembly mounted to the rear end of the housing, the cover assembly having an upper cover with a top wall mounted to areas of the top surface of the housing and below the lever when the lever is at the rear position, the cover assembly further including a lower cover assembled below the upper cover, the top wall of the upper cover extending into a space between the lever lock and the upper surface of the housing and including an upper locking portion that covers the upper lock receiving portion of the housing and locks the upper lock receiving portion from the front.

* * * * *